US009615990B2

(12) United States Patent
Turnbow-Faraci et al.

(10) Patent No.: US 9,615,990 B2
(45) Date of Patent: Apr. 11, 2017

(54) PERSONAL CARE DEVICE WITH CONVERTIBLE HANDLE AND TREATMENT HEAD, THE TURNBOW BUTTERFLY MULTI USE MASSAGE KIT

(71) Applicants: Debbra Kay Turnbow-Faraci, Park Ridge, IL (US); Dominic Daniel Faraci, II, Park Ridge, IL (US)

(72) Inventors: Debbra Kay Turnbow-Faraci, Park Ridge, IL (US); Dominic Daniel Faraci, II, Park Ridge, IL (US)

(73) Assignee: GRACE WELLNESS PRODUCTS, INC., Park Ridge, IL (US)

( * ) Notice: Subject to any disclaimer, the term of this patent is extended or adjusted under 35 U.S.C. 154(b) by 439 days.

(21) Appl. No.: 13/998,732

(22) Filed: Dec. 2, 2013

(65) Prior Publication Data

US 2015/0150758 A1 Jun. 4, 2015

(51) Int. Cl.
*A61H 7/00* (2006.01)
*A61H 39/04* (2006.01)

(52) U.S. Cl.
CPC ..... *A61H 7/003* (2013.01); *A61H 7/007* (2013.01); *A61H 39/04* (2013.01); *A61H 2201/0192* (2013.01); *A61H 2201/105* (2013.01); *A61H 2201/1623* (2013.01); *A61H 2201/1685* (2013.01); *A61H 2201/1695* (2013.01)

(58) Field of Classification Search
CPC ..... A61H 7/003; A61H 7/007; A61H 39/04; A47K 7/02
See application file for complete search history.

(56) References Cited

U.S. PATENT DOCUMENTS

| | | | | | |
|---|---|---|---|---|---|
| 723,725 | A * | 3/1903 | Schillberg | G01F 23/74 | 73/308 |
| 1,587,753 | A * | 6/1926 | Bretsnyder | A47K 7/022 | 15/222 |
| 2,576,338 | A * | 11/1951 | Gamble | A47K 7/02 | 15/160 |
| 4,374,588 | A * | 2/1983 | Ruggles | A63B 21/0004 | 192/93 A |
| 4,485,807 | A * | 12/1984 | Gueret | A61H 7/003 | 601/154 |
| 5,285,774 | A * | 2/1994 | Stachurski | A46B 5/002 | 132/129 |
| 2005/0201811 | A1* | 9/2005 | Russell | A45D 34/041 | 401/6 |
| 2007/0066919 | A1* | 3/2007 | Gueret | A61H 7/003 | 601/138 |

* cited by examiner

*Primary Examiner* — Justine Yu
*Assistant Examiner* — Timothy Stanis
(74) *Attorney, Agent, or Firm* — Grogan, Tuccillo & Vanderleeden, LLP

(57) ABSTRACT

A therapeutic device for massaging, cleansing, or delivering of liquid substances has a variably configurable handle that is adapted to function with a plurality of head attachments. The handles may be swiveled relative to each other at various angled positions, or they may be detached to function as two, separate devices.

12 Claims, 11 Drawing Sheets

PERSONAL CARE DEVICE WITH CONVERTIBLE HANDLE AND TREATMENT HEAD, THE TURNBOW BUTTERFLY MULTI USE MASSAGE KIT

CROSS-REFERENCE TO RELATED APPLICATIONS

This application is related to, and claims priority from, U.S. Provisional Application No. 61/731,197, filed on Nov. 29, 2012.

FIELD OF THE DISCLOSURE

The present disclosure relates to a system, a method and a device for inter alia acupressure, reflexology, massage, peripheral wound and personal care, and/or sanitary and hygiene care.

BACKGROUND OF THE DISCLOSURE

Various types of devices exist for specific uses, such as, for example, massage, personal care, skin care or substance application for self-use or to be operated by a professional care giver. Typically such known devices are limited to bath brushes, massagers or lotion applicators. These known devices are generally limited to a single handle configuration.

An unmet need exists for a device that may provide multiple functions, including preventative, maintenance, therapeutic, rehabilitation, or the like, which has variable configuration handles and that is adapted to function with a plurality of head attachments. The present disclosure provides a novel system, method and device that fulfill this unmet need.

SUMMARY OF THE DISCLOSURE

According to one non-limiting example of the disclosure, a system, a method, and a device are provided for performing multiple functions. The device comprises a variable configuration handle that is adapted to function with a plurality of head attachments. These attachments can provide the user the ability to perform acupressure, reflexology, massage, application of lotion, cleansers etc. anywhere on their body with a challenged range of motion or not.

The device may comprise two arms that are pivotally attached to each other at a junction and that can be variably positioned between an aligned position in which they are closed toward each other to function as a single handle, a fully opened position in which they are spread to opposite side of the junction and varying positions between the closed and opened positions. The device may further comprise one or more attachments that may be attachable to at least one of the two arms. The attachments may include heads having different shapes, sizes, textures, colors, configurations, and the like. The attachments may be adapted to be attached to, for example, the junction of the two arms. The attachments may include, but are not limited to, complimenting discs that, when incorporated, may provide various options for use to a user.

The discs are user-friendly, and may be provided as individual, or combined and attached to the interior of each handle of the two arms, thereby creating two separate single handle double-sided products with four diverse and specific result oriented surfaces.

The device, including the two arms and attachment(s), may include a naturally occurring and/or man-made material, including, but not limited to, for example, a metal, a plastic, a resin, a nanocellulose composition, a magnet, and/or the like.

Additional features, advantages, and embodiments of the disclosure may be set forth or apparent from consideration of the detailed description, drawings and attachment. Moreover, it is to be understood that the foregoing summary of the disclosure and the following detailed description, drawings and attachment are exemplary and intended to provide further explanation without limiting the scope of the disclosure as claimed.

BRIEF DESCRIPTION OF THE DRAWINGS

The accompanying drawings, which are included to provide a further understanding of the disclosure, are incorporated in and constitute a part of this specification, illustrate embodiments of the disclosure and together with the detailed description and attachment serve to explain the principles of the disclosure. No attempt is made to show structural details of the disclosure in more detail than may be necessary for a fundamental understanding of the disclosure and the various ways in which it may be practiced. In the drawings.

Figure 1:
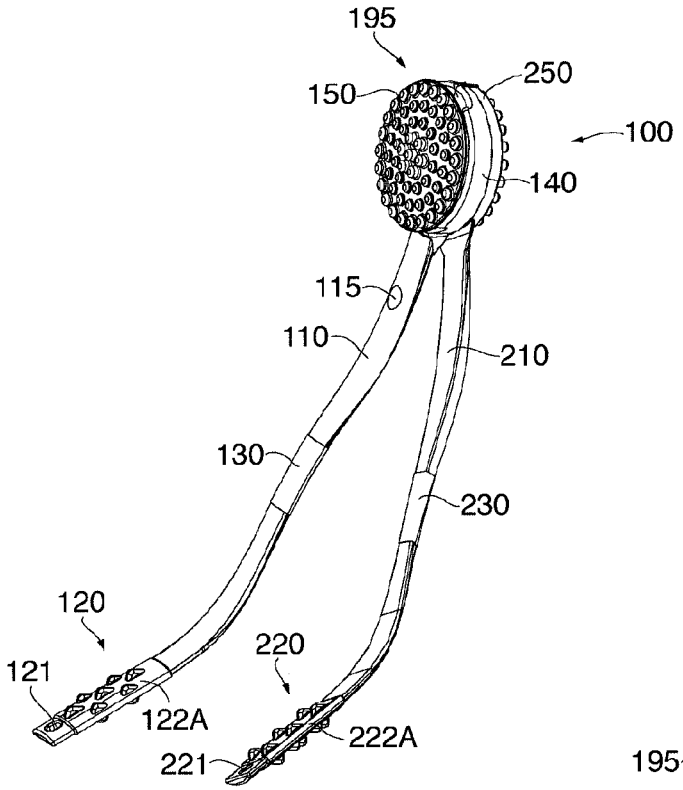
FIG. 1 shows a perspective view of an example of a device constructed According to the principles of the disclosure.

The present disclosure is further described in the detailed description and attachment that follow.

DETAILED DESCRIPTION OF THE DISCLOSURE

The disclosure and the various features and advantageous details thereof are explained more fully with reference to the non-limiting embodiments and examples that are described and/or illustrated in the accompanying drawings and detailed in the following description and attachment. It should be noted that the features illustrated in the drawings and attachment are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the disclosure. The examples used herein are intended merely to facilitate an understanding of ways in which the disclosure may be practiced and to further enable those of skill in the art to practice the embodiments of the disclosure. Accordingly, the examples and embodiments herein should not be construed as limiting the scope of the disclosure. Moreover, it is noted that like reference numerals represent similar parts throughout the several views of the drawings.

The terms "including", "comprising" and variations thereof, as used in this disclosure, mean "including, but not limited to", unless expressly specified otherwise.

The terms "a", "an", and "the", as used in this disclosure, means "one or more", unless expressly specified otherwise.

Devices that are in communication with each other need not be in continuous communication with each other, unless expressly specified otherwise. In addition, devices that are in communication with each other may communicate directly or indirectly through one or more intermediaries.

Although process steps, method steps, algorithms, or the like, may be described in a sequential order, such processes, methods and algorithms may be configured to work in alternate orders. In other words, any sequence or order of steps that may be described does not necessarily indicate a requirement that the steps be performed in that order. The steps of the processes, methods or algorithms described herein may be performed in any order practical. Further, some steps may be performed simultaneously.

When a single device or article is described herein, it will be readily apparent that more than one device or article may be used in place of a single device or article. Similarly, where more than one device or article is described herein, it will be readily apparent that a single device or article may be used in place of the more than one device or article. The functionality or the features of a device may be alternatively embodied by one or more other devices which are not explicitly described as having such functionality or features.

FIG. 1 shows an example of a device 100 for acupressure, reflexology, massage, peripheral wound and personal care, and/or sanitary and hygiene care. The device 100 includes a pair of arms 110, 210, and a head portion 195. An end of each of the arms 110, 210 may terminate into the head portion 195, and an opposite end 120, 220 of the arms 110, 210, respectively, may be configured to move closer toward each other, or further away from each other through user manipulation.

The arm 110 (210) may include the end 120 (220), a middle section 130 (230) and a contact portion 150 (250). The arm 110 (210) may include a cavity formed by the outer shell of the arm 110 (210), which may be filled with a liquid, such as, for example, a cleanser (e.g., soap, shampoo, or the like), a skin moisturizer (e.g., a lotion, an oil, or the like), or the like. The arm 110 (210) may include an opening 115 (215) through which the liquid may be injected or poured into the arm 110 (210). The arm 110 (210) may include a cap 112 (212) (shown in FIG. 6) to seal the opening 115 (215). The end 120 (220) may include one or more members 122A (222A) that may be used to facilitate better grip of the arms 110, 210. The members 122A (222A) may also be used, for example, as a contact portion for contact with skin, tissue, etc. on the user. The end 120 (220) may include an opening 121 (221) to allow for hanging of the device 100 on a hook or nail, or to receive, for example, a strap, or the like, so that it may be hung on a shower head, door handle, or the like.

Figure 8:
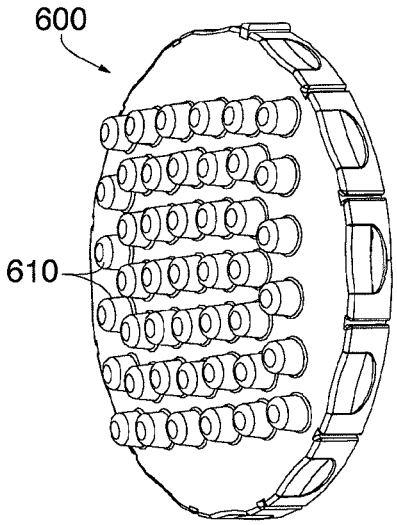
FIG. 8 shows an example of a head attachment constructed according to the principles of the disclosure.
Figure 9:
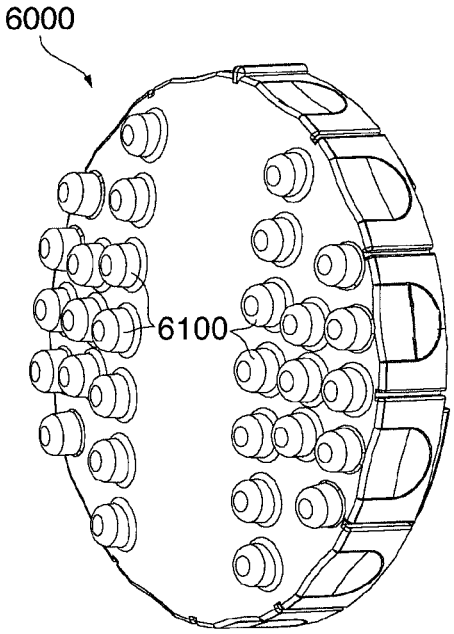
FIG. 9 show another example of a head attachment constructed according to the principles of the disclosure.

The contact portion 150 (250) may include a plurality of protrusions (e.g., protrusions 610 in FIG. 8 or protrusions 6100 in FIG. 9). One or more of the protrusions may include a channel (not shown) and an opening to allow the liquid to be ejected from the contact portion 150 (250). The liquid may be supplied from the arm 110 (210). The contact portion 150 (250) may be removable from the head portion 195, or it may be integrally formed (e.g., as one piece) with the arm 110 (210).

Figure 2:
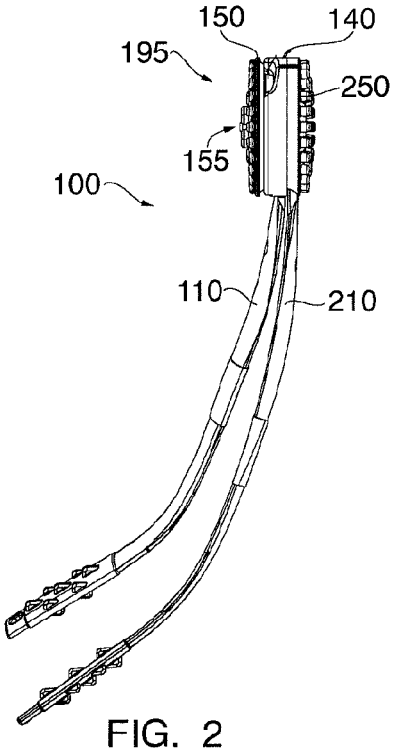
FIG. 2 shows a side view of the device shown in FIG. 1.
Figure 6:
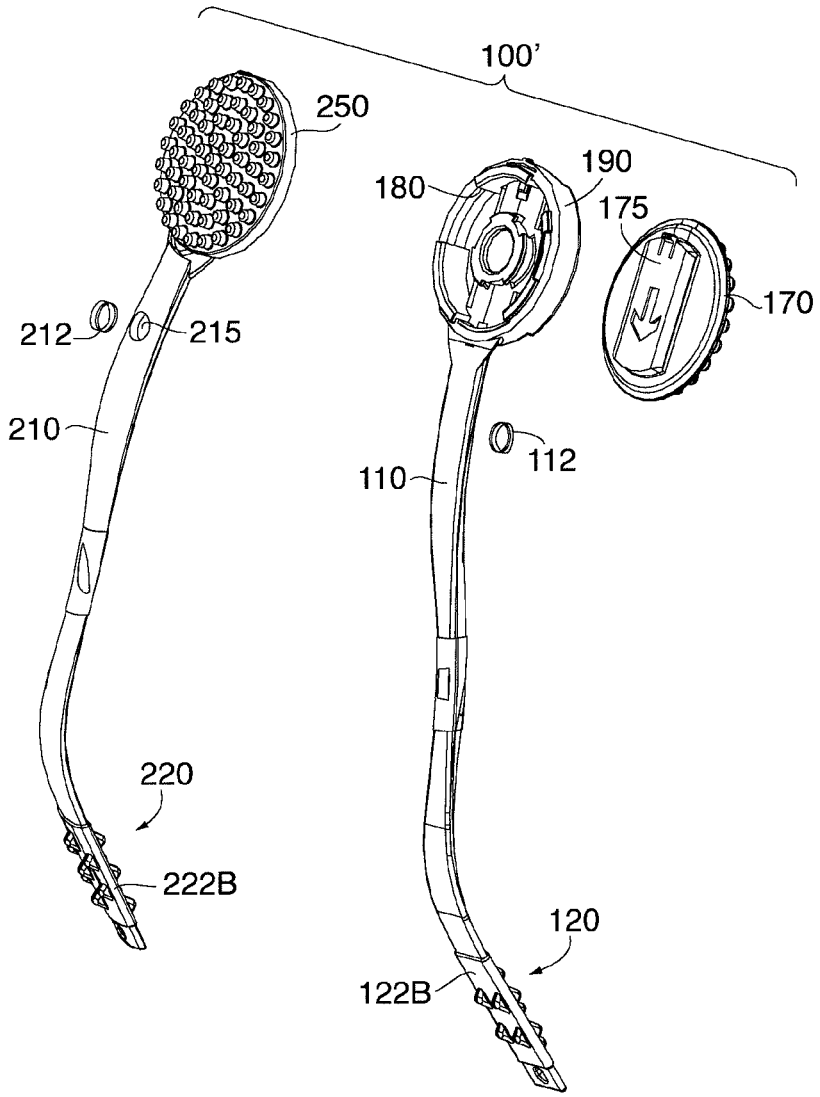
FIG. 6 shows an exploded view of the device shown in FIG. 4.
Figure 7:
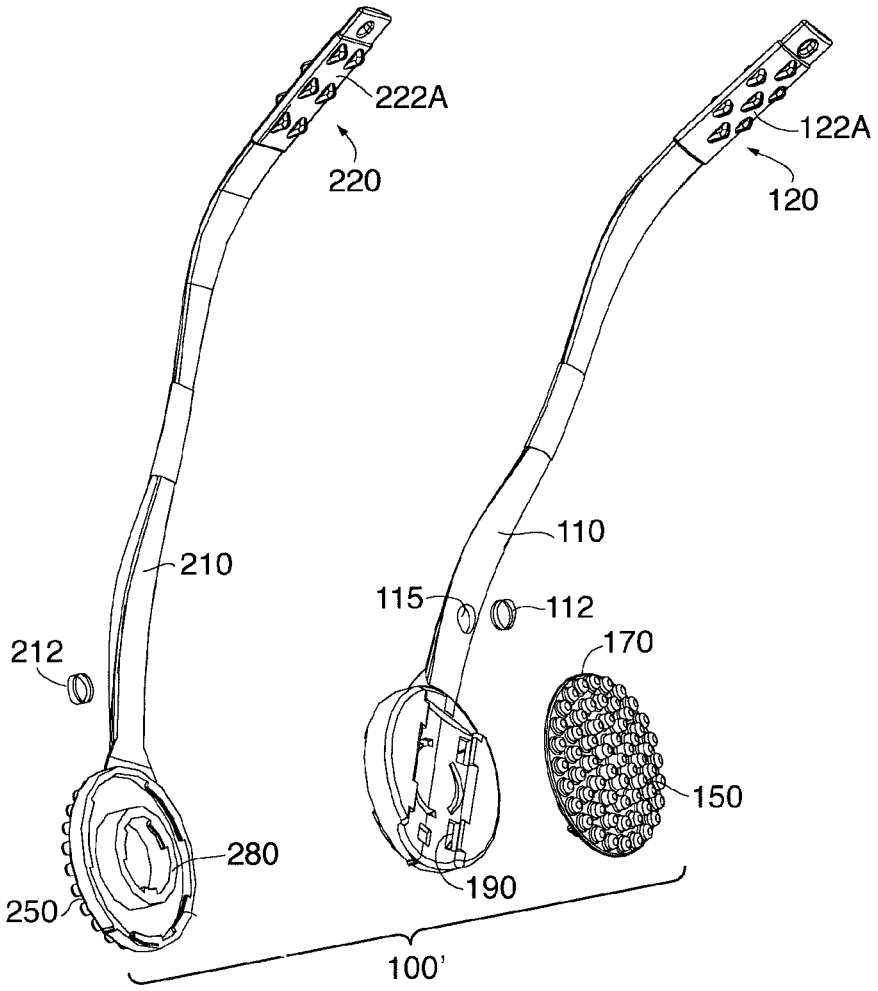
FIG. 7 shows another exploded view of the device shown in FIG. 4.

FIG. 2 shows a side view of the device shown in FIG. 1. In this embodiment of the device 100, the contact portion 150 may include a raised portion 155. Further, the contact portion 150 may be configured to be removed from the head portion 195. After the contact portion 150 is removed from the head portion 195, a head attachment (e.g., head attachment 600 shown in FIG. 8, head attachment 6100 shown in FIG. 9, or the like) may be affixed to the head portion 195 by a fastener (such as, e.g., a guide track 190 as seen in FIG. 7, a tongue and grove 180 as seen in FIG. 6, or the like).

Figure 3:
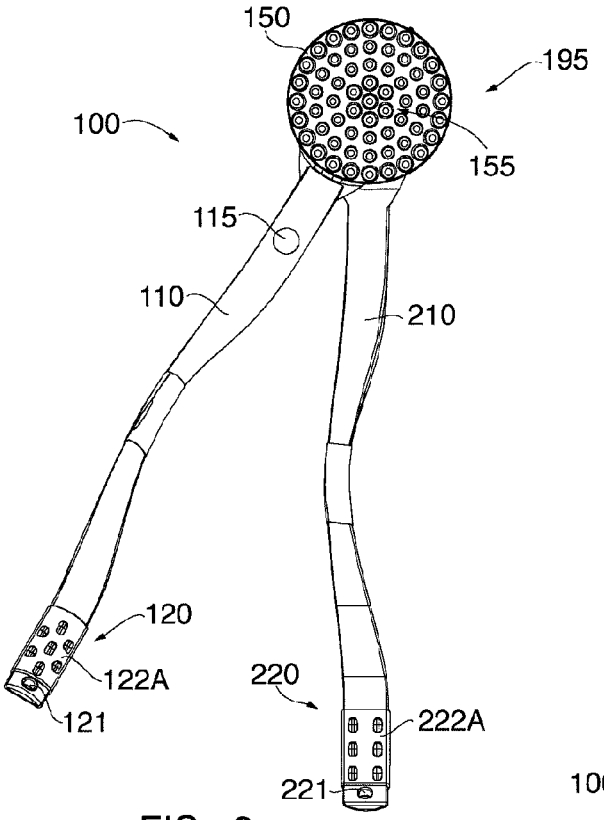
FIG. 3 shows another view of the device shown in FIG. 1.
Figure 5:
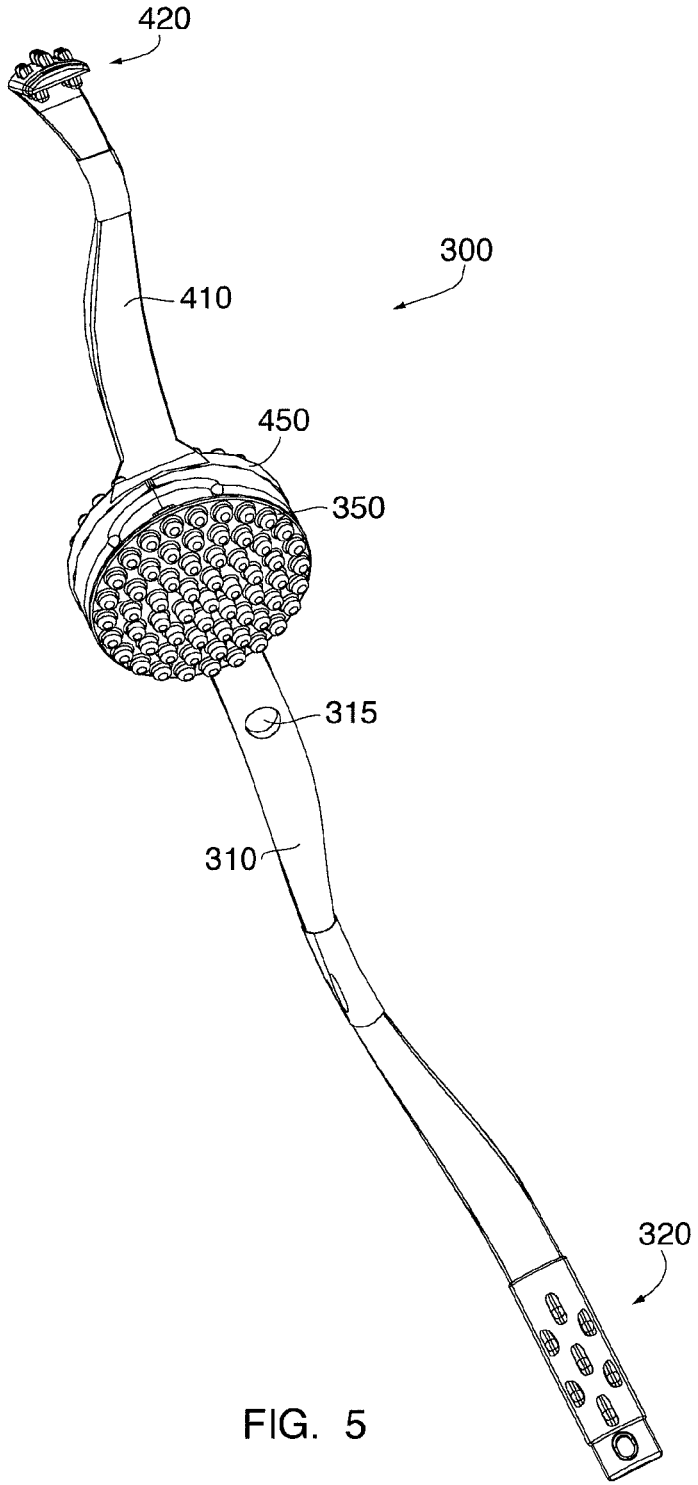
FIG. 5 shows yet another example of a device constructed according to the principles of the disclosure.

FIG. 3 shows another view of the device 100. In this view, the arms 110 and 210 are shown spread apart from each other to form an angle between them of about thirty degrees. The arms 110 and 210 may be pivoted about the head portion 195 to any desirable configuration such as, for example, one-hundred and eighty degrees apart as shown in FIG. 5. The arms 110 and 210 can also be positioned to directly overlap one another and, thus, enable single-handed use. The versatility of configuring the relative angle between the arms 110 and 210 to any desirable position enables users to select a configuration that suits their personal needs or limits. The relative movement between the arms 110 and 210 is facilitated by a swiveling relationship between the head portion of the first arm 110 shown at guide track 190 in FIG. 7 and the cylindrical guide portion 280 of the head portion of the second arm 210. The guide portion 280 may be of any suitable configuration known to those skilled in the art, including the configuration shown in FIG. 14 (792, 794), to facilitate connection and disconnection from a mating or corresponding structure on the first arm 110 that allows swiveling or pivoting relative between the first arm 110 and the second arm 210.

Figure 4:
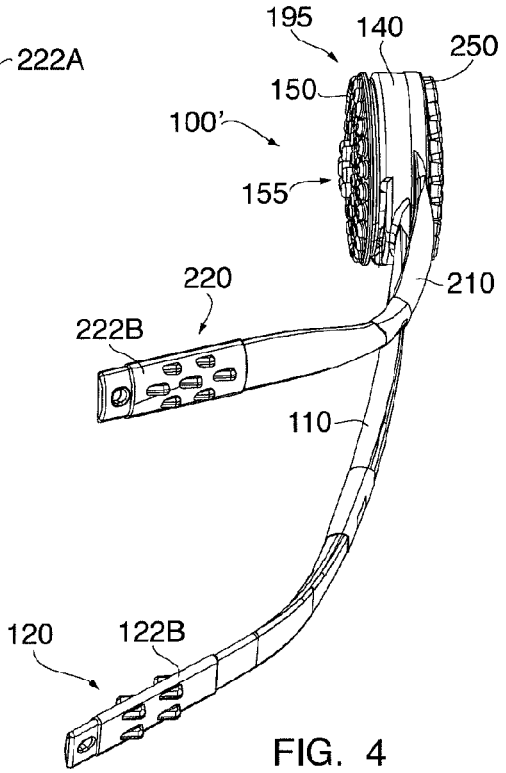
FIG. 4 shows a side view of another example of a device constructed according to the principles of the disclosure.

FIG. 4 shows a side view of another embodiment of a device 100', constructed according to the principles of the disclosure. As seen in FIG. 4, the end 120 (220) may include a different configuration and number of members 1228 (222B). The head portion 195 of the device 100' may be formed of a first arm portion 140 that may be coupled on one side to a non-contact side of the contact portion 250. The other side of the first arm portion 140 may be attached to the contact portion 150. Alternatively, the contact portion 150 may be integrally formed (e.g., molded) as a single piece with the arm portion 140.

FIG. 5 shows yet another example of a device 300 constructed according to the principles of the disclosure. The device 300 may include arms 310, 410, and a head portion that comprises contact portions 350, 450. As seen in FIG. 5, at least one of the arms 310, 410, may be provided with an opening 315. The ends 320, 420 of the arms 310, 410 may be configured so as to be adjustable (e.g., bend) by the user.

FIG. 6 shows an exploded view of the device 100'.

FIG. 7 shows another exploded view of the device 100'.

FIG. 8 shows an example of a head attachment 600 constructed according to the principles of the disclosure. The head attachment 600 is configured to be attachable to the head portion 195 of the device 100 (100', or 300), or, e.g., the contact portion 140 of the arm 110 (220). The head attachment 600 may include a plurality of protrusions 610, which may include an opening to eject a liquid.

FIG. 9 show another example of a head attachment 6000 constructed according to the principles of the disclosure. The head attachment 6000 is configured to be attachable to the head portion 195 of the device 100 (100', or 300), or, e.g., the contact portion 140 of the arm 110 (220). The head attachment 6000 may include a plurality of protrusions 6100, which may include an opening to eject a liquid.

According to an aspect of the disclosure, the head attachments 600, 6000 may be configured to attach to each other so as to provide, e.g., a hand-held, soap-like device that may be used to contact skin, tissue, etc. The thus-configured device may be partially or wholly encapsulated in, e.g., a fabric (e.g., cloth) casing, which may be in the shape of, e.g., a shower cap.

Figure 10:
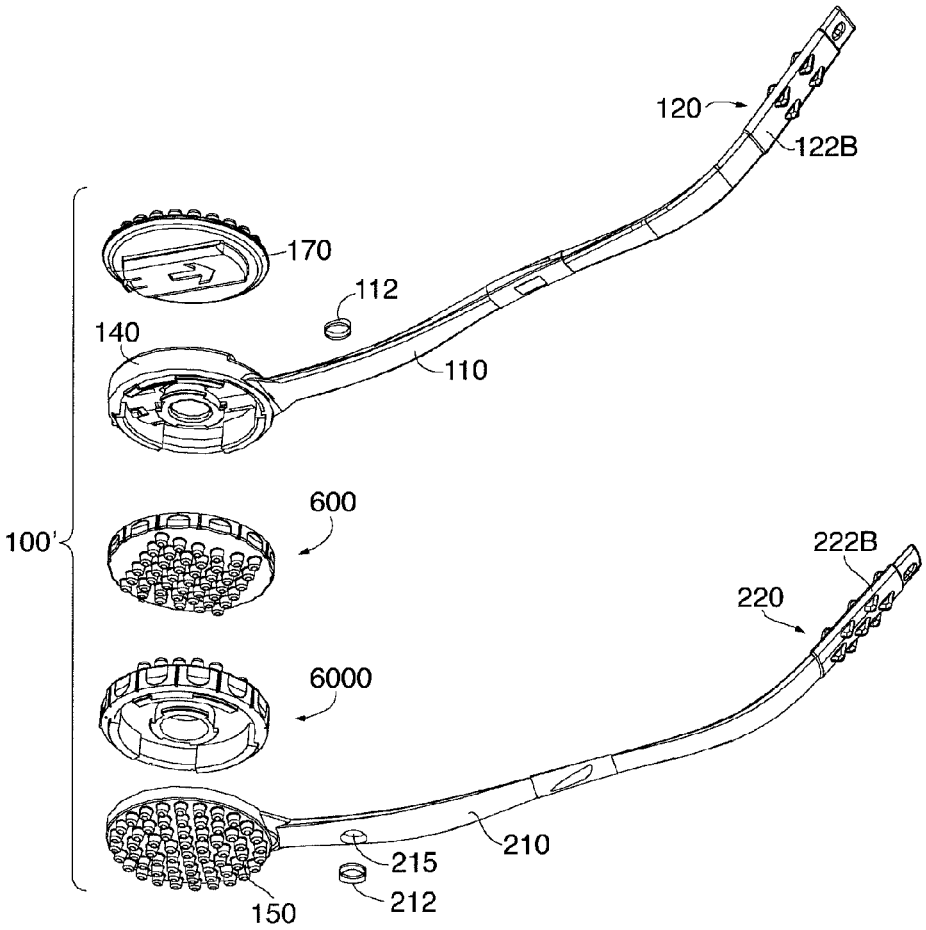
FIG. 10 shows an exploded view of the head attachments of FIGS. 8 and 9 being attached to the device shown in FIG. 4.

FIG. 10 shows an exploded view of device 100' with the head attachments 600, 6000, and removable contact portion 170.

Figure 11:
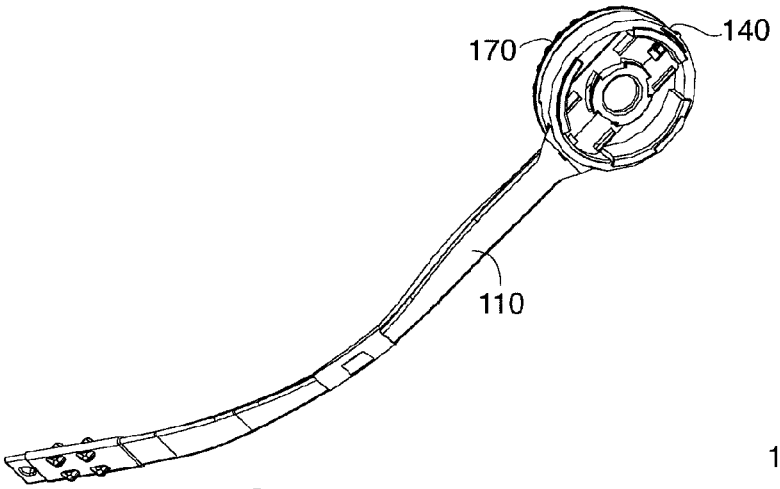
FIG. 11 shows a view of one of the arms of the device shown in FIG. 4.
Figure 12:
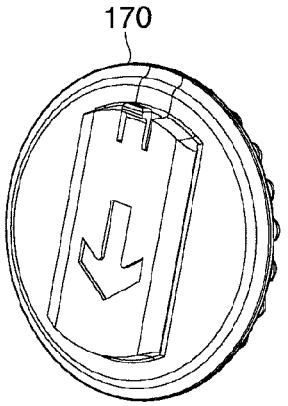
FIG. 12 shows an example of a head attachment that may be attached to the arm shown in FIG. 11.
Figure 13:
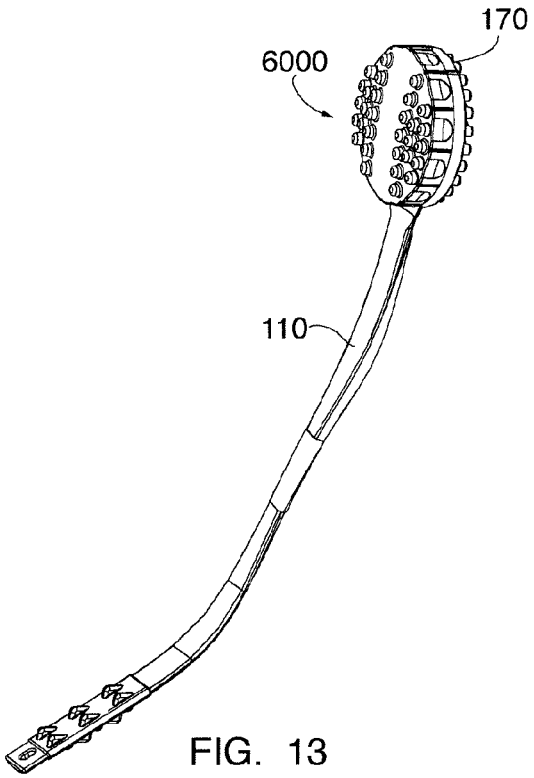
FIG. 13 shows a perspective view an arm of the device shown in FIG. 4 attached to an attachment head.

FIGS. 11-13 show various stages of assembly (or removal) of the contact portion 170 from the arm 110 (210) of the device 100'. In particular, FIG. 11 shows the arm 110 (210) before the contact portion 170 is affixed to the arm 110 (210). FIG. 12 shows an example of an attachment side of the contact portion 170 that may be attached to the arm 110 (210). FIG. 13 shows a perspective view the arm 110 (210) after the contact portion 170 is attached to the arm 110 (210). The contact portion 170 and/or the head attachment 6000 may be integrally formed with the arm 110 (210). Either, or both the contact portion may be configured to be removable from the arm 110 (210), where it (they) are not integrally formed with the arm 110 (210).

Figure 14:
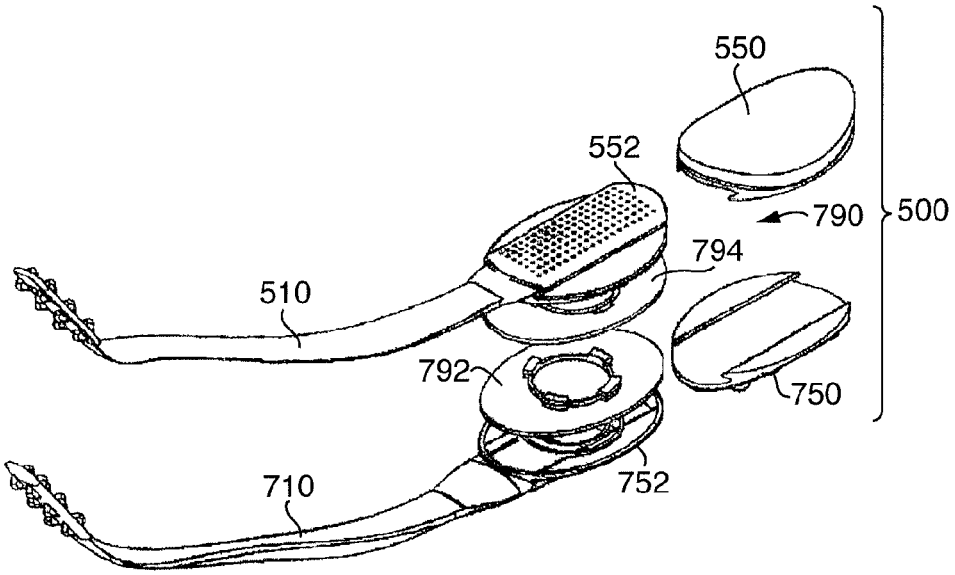
FIG. 14 shows an exploded view of another device constructed according to the principles of the disclosure.

FIG. 14 shows an exploded view of another device 500 that is constructed according to the principles of the disclosure. The device 500 comprises arms 510, 710, and a head portion 790. The head portion 790 may include a first head member 792 and a second head member 794. The members 792, 794 may be configured to maintain the arms 510, 710 coupled to each other while allowing for rotational movement of the arms 510, 710 with respect to each other. The member 792, 794 may provide for reduced friction during spreading (or collapsing) of the arms 510, 710 with respect to each other. The arm 510 (710) may include a contact mating portion 552 (752) that is configured to mate with, or attach to a contact portion 550 (750).

Figure 15:
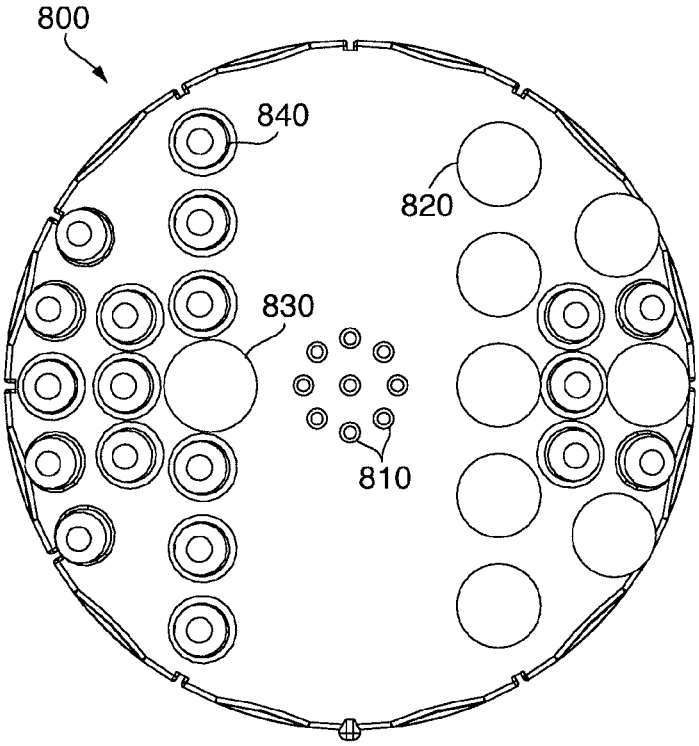
FIG. 15 shows yet another example of an attachment head constructed according to the principles of the disclosure.

FIG. 15 shows yet another example of an attachment head 800, constructed according to the principles of the disclosure. The attachment head 800 may be configured to attach to an arm 110 (210) of the device 100 (100', 300, 500, or the like). The attachment head 800 may include a plurality of contact members 820, 830, 840, which may have a variety of shapes, sizes, and configurations. The contact members 820, 830, 840, may include openings to eject a liquid. The attachment head 800 may include a plurality of openings 810 to eject a liquid.

Figure 16:
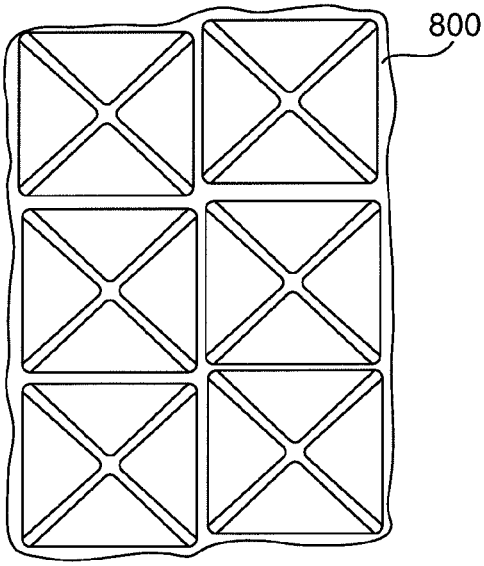
FIG. 16 shows an example of a pattern that may be provided on an attachment head, according to the principles of the disclosure.

FIG. 16 shows an example of a pattern that may be provided on an attachment head (e.g., attachment head 800, shown in FIG. 15). The contact members (e.g., on the attachment head 800) may include, e.g., a pyramid pattern. Alternatively (or additionally), other patterns may be implemented for the contact members, including, e.g., semi-spheres, cylinders, blocks, spheres, stars, and the like.

Figure 17:
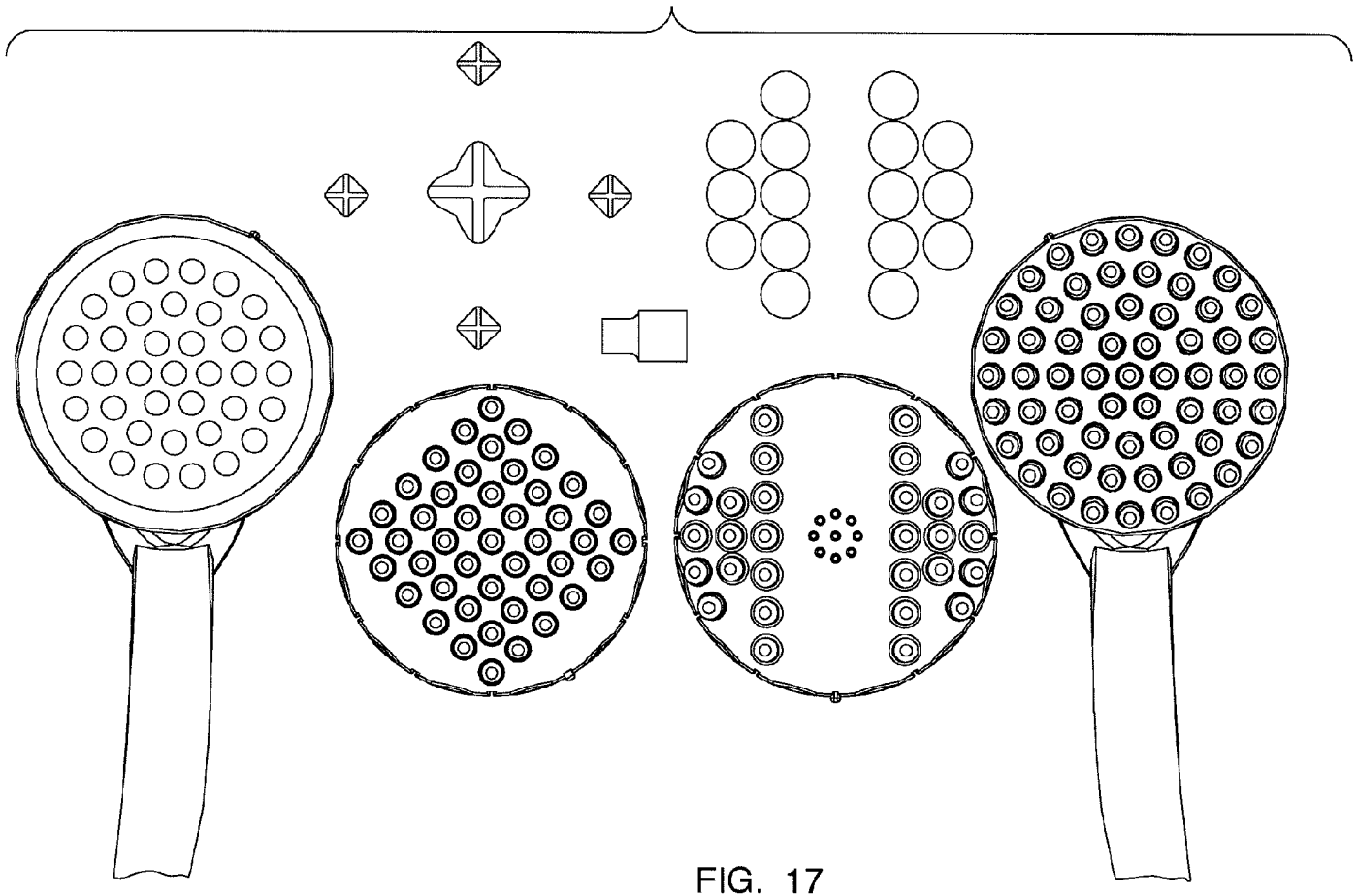
FIG. 17 shows examples of various shapes, sizes, and configurations of contact members that may be provided on the device that is constructed according to the principles of the disclosure.

FIG. 17 shows examples of various shapes, sizes, and configurations of contact members that may be provided on the device that is constructed according to the principles of the disclosure.

While the disclosure has been described in terms of exemplary embodiments, those skilled in the art will recognize that the disclosure can be practiced with modifications in the spirit and scope of the appended claims. These examples are merely illustrative and are not meant to be an exhaustive list of all possible designs, embodiments, applications or modifications of the disclosure.

What is claimed is:

1. A handheld, multi-purpose device comprising:

a first handle having a proximal portion, an intermediate portion, and a distal portion;

a second handle having a proximal portion, an intermediate portion, and a distal portion;

a first head portion attached to said first handle at the distal portion of said first handle and having a first massage surface including a plurality of raised bumps or ridges; and a second head portion attached to said second handle at the distal portion of said second handle and having a second massage surface including a plurality of raised bumps or ridges;

wherein said first head portion and said second head portion are rotatably coupled to one another about a common axis; and wherein said first massage surface and said second massage surface are generally parallel to one another and face in generally opposite directions away from one another, and define a fixed distance therebetween.

2. The device according to claim 1, further comprising:

a massage disc releasably attachable to one of said first head portion and said second head portion, said massage disc having a plurality of raised bumps on one surface.

3. The device according to claim 1, further comprising:

a liquid retaining disc releasably attachable to one of said first head portion and said second head portion, said liquid retaining disc being porous and adapted to retain a liquid therein and to release said liquid when external pressure is applied to said liquid retaining disc.

4. The device according to claim 1, further comprising:

a magnetic disc releasably attachable to one of said first head portion and said second head portion, said magnetic disc possessing magnetic properties.

5. The device according to claim 1, wherein:

said first massage surface and said second massage surface each include a plurality of raised bumps or ridges.

6. The device according to claim 1, wherein:

said first head portion and said second head portion are releasably attached to one another.

7. The device according to claim 1, wherein:

said first massage surface and said second massage surface are removable from said first head portion and said second said portion, respectively.

8. The device according to claim 1, wherein:

said proximal portion of at least one of said first handle and said second handle is formed with a plurality of protrusions.

9. The device according to claim 8, wherein:

said proximal portion of at least one of said first handle and said second handle includes an aperture configured to receive a hook therethrough.

10. A handheld, multi-purpose device comprising:

a first handle having a proximal portion, an intermediate portion, and a distal portion;

a second handle having a proximal portion, an intermediate portion, and a distal portion;

a first head portion attached to said first handle at the distal portion of said first handle and having a first massage surface including a plurality of raised bumps or ridges; and a second head portion attached to said second handle at the distal portion of said second handle and having a second massage surface having a plurality of raised bumps or ridges;

wherein said first head portion and said second head portion are releasably coupled to one another and rotatable about a common axis; and wherein when said first head portion and said second head portion are coupled to one another, said first massage surface and said second massage surface are generally parallel to one another and face in generally opposite directions, and define a fixed distance between said first massage surface and said second massage surface.

11. The device according to claim 10, wherein:

said first massage surface and said second massage surface are removable from said first head portion and said second said portion, respectively.

12. The device according to claim 10, wherein:

said first head portion directly engages and contacts said second head portion.

* * * * *